US008324542B2

(12) United States Patent
Frey, Jr.

(10) Patent No.: US 8,324,542 B2
(45) Date of Patent: Dec. 4, 2012

(54) COMMAND METHOD FOR SPINNING PROJECTILES

(75) Inventor: Robert D Frey, Jr., Bolton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 260 days.

(21) Appl. No.: 12/405,268

(22) Filed: Mar. 17, 2009

(65) Prior Publication Data

US 2010/0237184 A1 Sep. 23, 2010

(51) Int. Cl.
*F41G 7/30* (2006.01)
*F41G 7/00* (2006.01)

(52) U.S. Cl. ..... 244/3.14; 244/3.1; 244/3.11; 244/3.13

(58) Field of Classification Search ..... 244/3.1–3.3; 89/1.11; 342/61–65, 175, 188, 195; 102/382, 102/384, 473, 501
See application file for complete search history.

(56) References Cited

U.S. PATENT DOCUMENTS

| | | | | | |
|---|---|---|---|---|---|
| 3,025,024 | A | * | 3/1962 | Hawes | 244/3.13 |
| 3,746,288 | A | * | 7/1973 | Schoneborn | 244/3.14 |
| 3,963,195 | A | * | 6/1976 | Coxe et al. | 244/3.11 |
| 4,072,281 | A | * | 2/1978 | Miller et al. | 244/3.16 |
| 4,097,007 | A | * | 6/1978 | Fagan et al. | 244/3.11 |
| 4,107,678 | A | * | 8/1978 | Powell | 342/62 |
| 4,245,800 | A | * | 1/1981 | Henderson | 244/3.13 |
| 4,347,996 | A | * | 9/1982 | Grosso | 244/3.16 |
| 4,422,601 | A | * | 12/1983 | Chavany et al. | 244/3.13 |
| 4,641,801 | A | * | 2/1987 | Lynch et al. | 244/3.14 |
| 4,750,689 | A | * | 6/1988 | Yf | 244/3.14 |
| 4,967,981 | A | * | 11/1990 | Yff | 244/3.21 |
| 4,979,696 | A | * | 12/1990 | Yff | 244/3.14 |
| 5,039,029 | A | * | 8/1991 | Taylor et al. | 244/3.11 |
| 5,099,246 | A | * | 3/1992 | Skagerlund | 244/3.14 |
| 5,163,637 | A | * | 11/1992 | Hansen | 244/3.21 |
| 5,259,567 | A | | 11/1993 | Jano et al. | |
| 5,344,099 | A | * | 9/1994 | Pittman et al. | 244/3.13 |
| 5,414,430 | A | * | 5/1995 | Hansen | 342/188 |
| 5,685,504 | A | * | 11/1997 | Schneider et al. | 244/3.11 |
| 5,788,180 | A | | 8/1998 | Sallee et al. | |
| 6,016,990 | A | * | 1/2000 | Small | 244/3.11 |
| 6,450,442 | B1 | * | 9/2002 | Schneider et al. | 244/3.14 |
| 6,483,455 | B2 | * | 11/2002 | Fleury et al. | 342/62 |
| 6,572,052 | B1 | * | 6/2003 | Hansen | 244/3.11 |
| 7,023,380 | B2 | * | 4/2006 | Schneider | 244/3.11 |
| 7,163,176 | B1 | | 1/2007 | Geswender et al. | |
| 7,193,556 | B1 | * | 3/2007 | Pereira et al. | 342/62 |

FOREIGN PATENT DOCUMENTS

| | | | |
|---|---|---|---|
| GB | 684229 | A | 12/1952 |
| WO | 83/03894 | A1 | 11/1983 |
| WO | 99/17130 | A2 | 4/1999 |

OTHER PUBLICATIONS

PCT Search Report dated May 5, 2010 of Patent Application No. PCT/US2010/026584 filed Mar. 9, 2010.

* cited by examiner

*Primary Examiner* — Bernarr Gregory
(74) *Attorney, Agent, or Firm* — Maine Cernota & Rardin; Andrew P. Cernota

(57) ABSTRACT

A system is provided for the remote control of a spinning projectile, the system comprising: a polarized radiation source emitting polarized radiation wherein commands are encoded; a projectile round; a polarized radiation receiver disposed on the projectile round and configured to receive the polarized radiation; and a projectile steering mechanism, the mechanism directing movement of the projectile according to the commands communicated by means of rotation of polarization of the polarized radiation source.

15 Claims, 6 Drawing Sheets

COMMAND METHOD FOR SPINNING PROJECTILES

FIELD OF THE INVENTION

The invention relates to projectiles, and more particularly, to a method for the remote direction of a spinning projectile.

BACKGROUND OF THE INVENTION

There is a desire to improve accuracy of projectiles by incorporating active control throughout the flight. Often in order to keep both package volume and cost to a minimum these precision rounds are controlled remotely. This is particularly true for small projectiles including bullets. A major difficulty arises in that the directing source is not in sync with the rotation of the spinning projectile. Commands to the spinning projectile are generally given in an inertial space reference and the round itself must maintain knowledge of its launch accelerations followed by the rapid spin rate required to maintain stability of the round through flight, on-board gyroscopes become cost prohibitive.

Polarized signals have been proposed for use in determining round orientation relative to a transmitted source. These approaches detect a polarized return from the round to determine when to issue fire commands from the ground station. This system is complicated by the need for a means of generating a return signal in order to coordinate the command from the ground.

An alternative approach has been proposed wherein a pair of polarized signals are transmitted and the round itself determines roll attitude. Such methods concentrate on the task of providing the round a means of determining absolute orientation in inertial space such that commands communicated in this reference system would be properly executed.

What is needed, therefore, are techniques for cost effective flight remote control of spinning projectiles.

SUMMARY OF THE INVENTION

One embodiment of the present invention provides a system for the remote control of a spinning projectile, the system comprising: a polarized radiation source emitting polarized radiation wherein commands are encoded; a projectile round; a polarized radiation receiver disposed on the projectile round and configured to receive the polarized radiation; a projectile steering mechanism, the mechanism directing movement of the projectile according to the commands communicated by means of rotation of polarization of the polarized radiation source.

Another embodiment of the present invention provides such a system wherein the radiation is radio waves.

A further embodiment of the present invention provides such a system wherein the radiation is light.

Yet another embodiment of the present invention provides such a system wherein the projectile steering mechanism comprises a moving mass system.

A yet further embodiment of the present invention provides such a system wherein the moving mass system comprises a moving mass control module, configured to control the moving mass motor configured to actuate a mass within the projectile according to commands issued by the moving mass module, and a moving mass position indicator whereby a position of the mass is provided to the moving mass control module.

Still another embodiment of the present invention provides such a system wherein the projectile steering mechanism comprises a thruster system.

A still further embodiment of the present invention provides such a system wherein the thruster system comprises a thruster control configured to activate and deactivate a thruster, the thruster being configured to provide a thrust impulse to divert the projectile into a preferred path.

Even another embodiment of the present invention provides such a system wherein the radiation receiver is disposed at a distal end of the projectile.

An even further embodiment of the present invention provides such a system further comprising a non-polarized radiation detector configured to receive a reference signal whereby ambiguity as a commanded thrust vector of the projectile round in inertia space is resolved.

A still yet further embodiment of the present invention provides such a system wherein the projectile steering mechanism comprises aerodynamic control surfaces.

One embodiment of the present invention provides a method for the active control of a spinning projectile in flight, the method comprising; launching a spinning projectile; directing polarized radiation toward a polarized radiation detector disposed on a distal end of the projectile, the detector receiving the polarized radiation being received by the projectile in a sinusoidal signal resulting from rotation of the projectile with two maxima for each rotation; communicating a maneuver command to the projectile by rotating the polarization thereby orienting the projectile thrust vector in inertial space.

Another embodiment of the present invention provides such a method further comprising embedding additional information in the polarized radiation.

A further embodiment of the present invention provides such a method, wherein communicating a maneuver command further comprises embedding a rapid series of pulses embedded on a polarized signal.

Still another embodiment of the present invention provides such a method further comprising resolving a positive and negative angle ambiguity by: commanding a maneuver; observing a resulting movement of the projectile with a detection and ranging system.

A still further embodiment of the present invention provides such a method, wherein the detection and ranging system is selected from the group of detection and ranging systems consisting of LADAR and RADAR.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
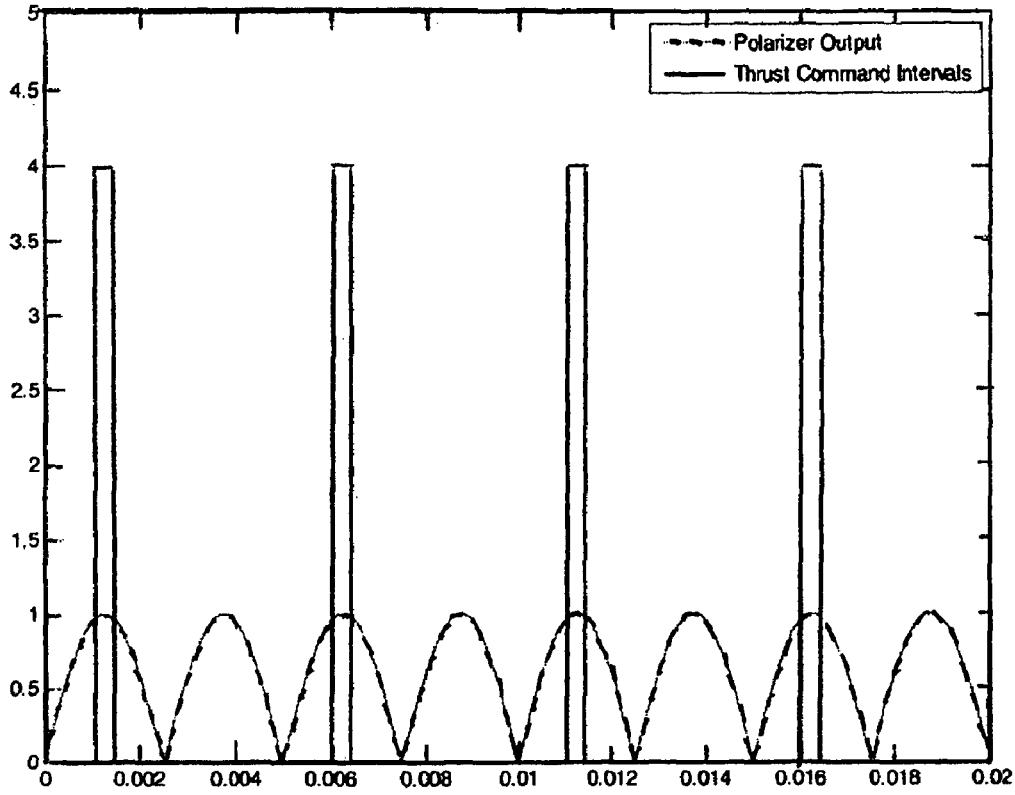
FIG. 1 is a graph illustrating peak response of a system for the guidance of a spinning projectile configured in accordance with one embodiment of the present invention.
Figure 2:
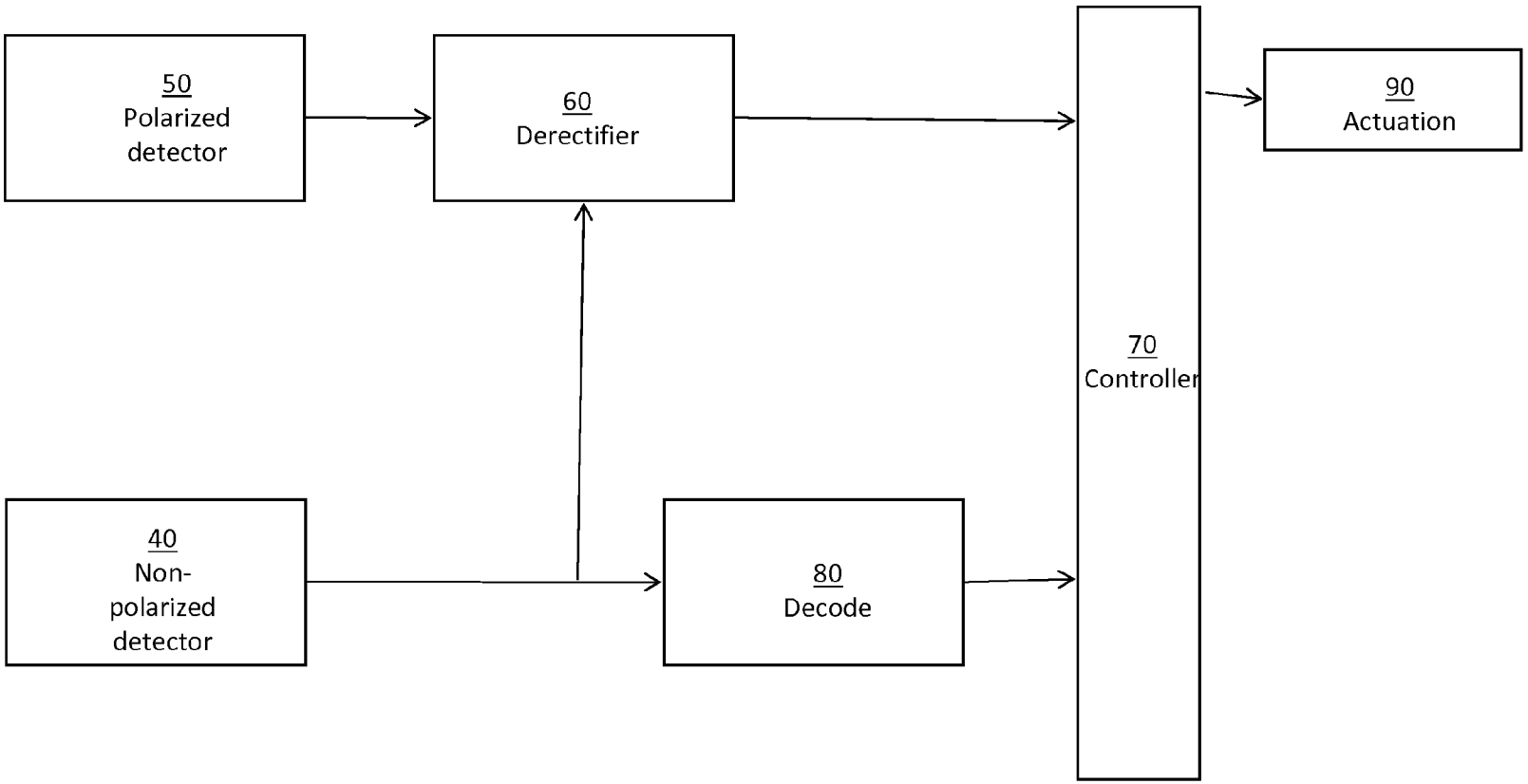
FIG. 2 is a block diagram illustrating a system for the guidance of a spinning projectile configured in accordance with one embodiment of the present invention.

One embodiment of the present invention, illustrated in FIG. 2 provides a polarized radiation source 30 to control a round. The round is launched from a gun barrel 10. The round 20 is fitted with a polarized detector 50. The polarization of the detector 50 on the round 20 is fixed relative to the body of the round 20. As the round 20 spins, the output of the polarized detector will appear as a rectified sinusoid. As illustrated in FIG. 1, twice a rotation the round will exhibit a peak response as the polarizer aligns with the polarization of the source. These peaks relate to particular roll attitudes of the source and will cause the peaks to vary relative to inertial space. Actuation or control of the round is synchronous to the detected sinusoidal output of the polarized detector allowing directional control of the round.

One embodiment of the present invention provides a distinctive method of communicating the maneuver command by variation of the directing source polarization. In such a system, rather than using the polarized source to communicate down orientation by fixing the polarization direction, the orientation of the polarization of the source is rotated in order to indicate thrust direction. One skilled in the art will appreciate that this approach can be applied to any round that is spinning in which the thrust or actuation 90 must be timed to provide the correct acceleration vector direction relative to inertial space.

Figure 3:
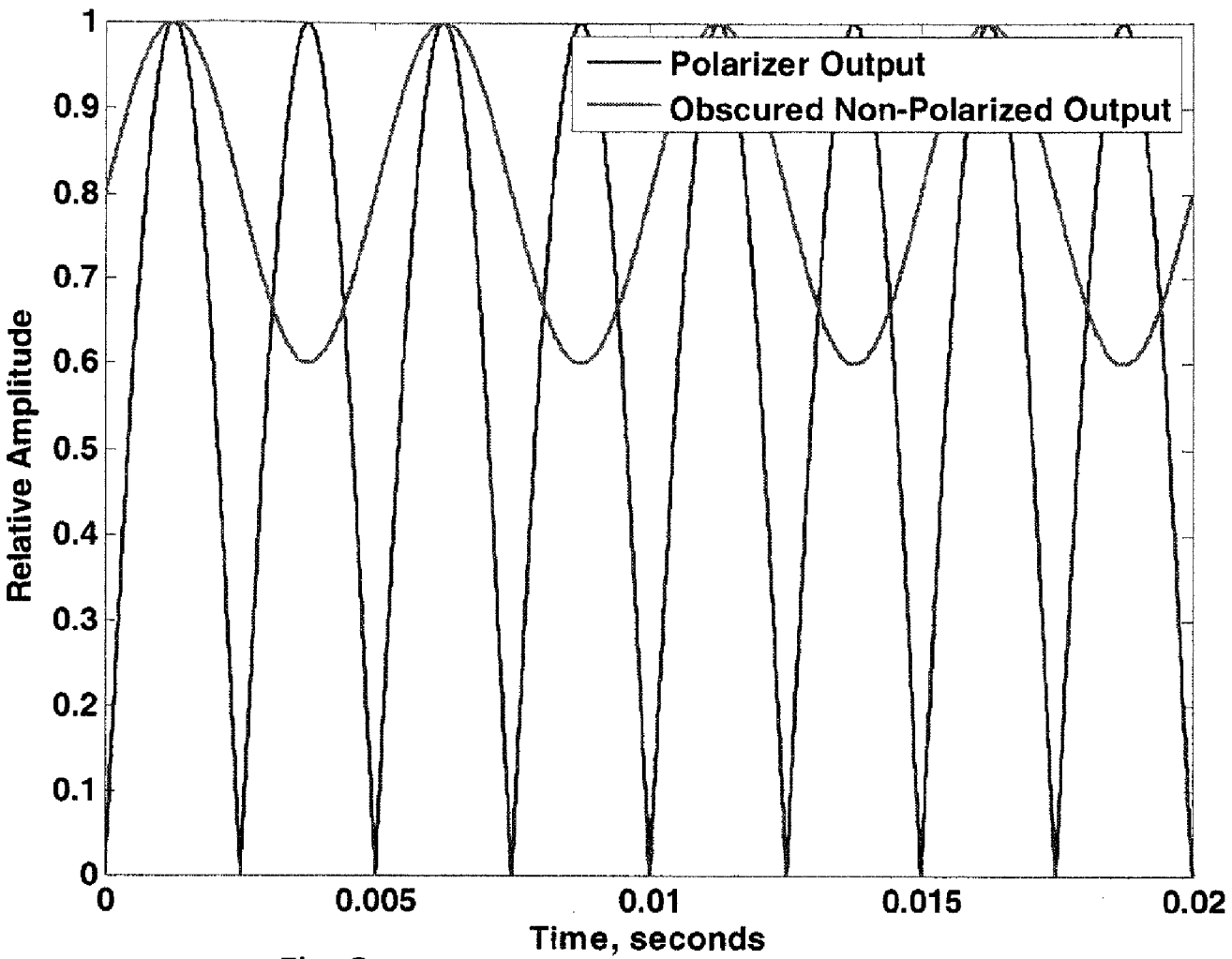
FIG. 3 is a graph illustrating polarized output used in a system configured in accord with one embodiment of the present invention.
Figure 4:
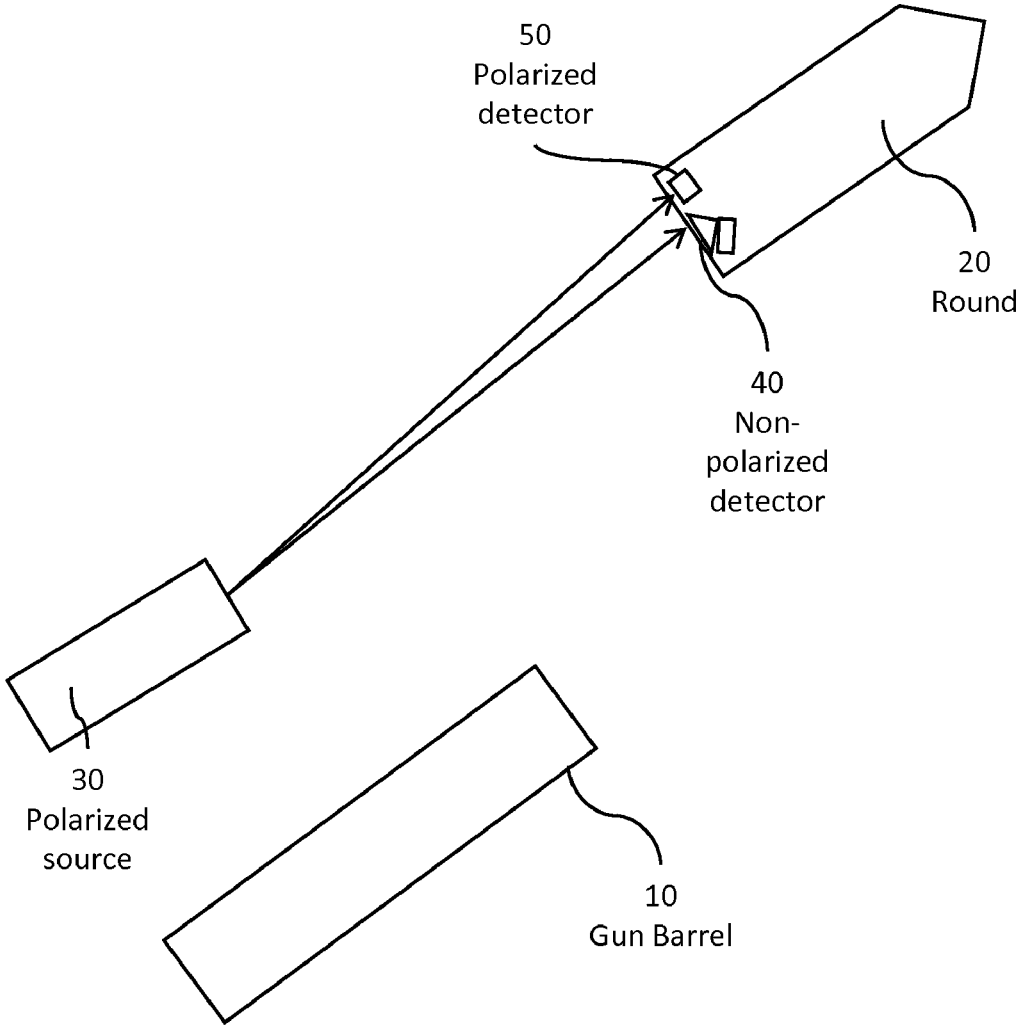
FIG. 4 is a block diagram illustrating a system for the guidance of a spinning projectile configured in accordance with one embodiment of the present invention.
Figure 6:
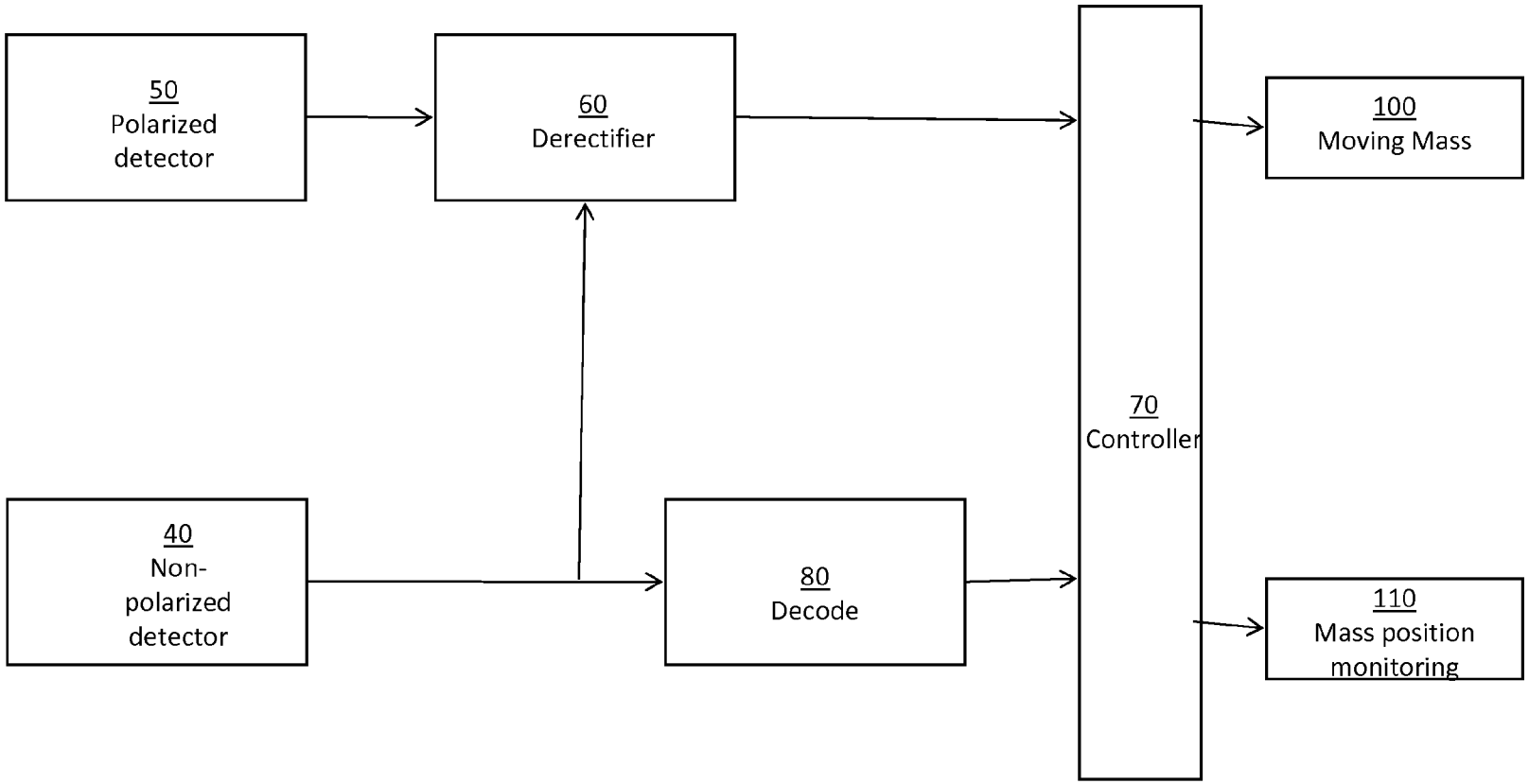
FIG. 6 is a flow chart illustrating a system for the guidance of a spinning projectile configured in accordance with one embodiment of the present invention and having a moving mass guidance system.

In one embodiment illustrated in FIG. 3, on a round is disposed a polarized detector 50 where polarized radiation is detected and the polarized radiation is passed through a derectifier 60. A non-polarized detector is used to sense the polarized command signal independent of roll orientation and passes the modulated signal to a magnitude decoder 80 that decodes the commanded magnitude embedded in the command signal. The derectified signal and decoded magnitude are then directed to the thrust controller 70 which then uses a thruster 90 to alter to the direction of the round. An alternative embodiment is illustrated in FIG. 6, illustrating a similar system wherein the direction of the round is controlled by motion of a moving mass 100, that moving mass 100 having a position monitored with a mass position monitoring system 110.

Figure 5:
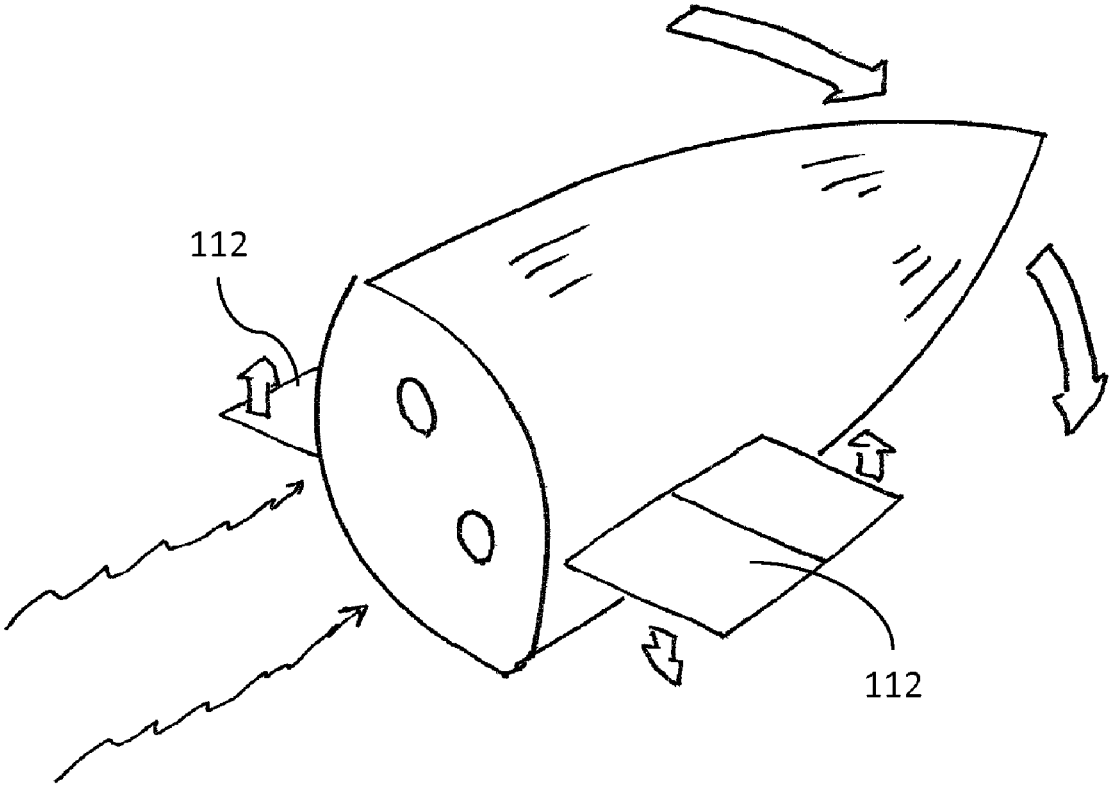
FIG. 5 is a perspective view illustrating a system for the guidance of a spinning projectile configured in accordance with one embodiment of the present invention having aerodynamic direction controls.

Another embodiment, illustrated in FIG. 5 can use aerodynamic control surfaces 112 such as wings or fins to develop maneuver thrust. In a spinning round, optimum thrust is developed from these surfaces when they are driven in a sinusoid at the spin frequency. The phase of the sinusoid determines the thrust direction and the amplitude of the sinusoid determines the thrust magnitude. The use of a polarized command source provides a direct command input to the generation of a sinuisoid that is in sync with the projectile rotation such that the thrust direction is dependent and tracks the command source polarization.

Some embodiments of the present invention require that sign and amplitude of the acceleration be varied in order to support more sophisticated guidance approaches. For these systems, a rapid series of pulses may be embedded on the polarized signal and encoded with the desired amplitude and sign. A second non-polarized detector 40 on the round can detect and decode 80 these signals in order to determine thrust amplitude and sign. The rapid variation of short pulses will not significantly impact the ability of the system to determine time phasing of the maneuver command to ensure proper orientation in inertial space.

The use of polarized signals suffers from the ambiguity of positive and negative angles. The output of the detected polarized signal will look like a rectified sinusoid in which the negative portion of the signal is flipped over to the positive. Various embodiments of the present invention have been identified to remove this ambiguity. The ambiguity may be resolved by commanding a maneuver and observing the response direction using the directing LADAR or RADAR system. In this type of system, the change in polarization must be a continuous variation so that once the round has selected an arbitrary polarity for the derectified sinusoid 60 it can be maintained by tracking the phase variation induced by changes in polarization orientation at the source.

An alternative embodiment of the present invention would recess and tilt the secondary non-polarized detector 40 used for amplitude and sign commands on the rear of the projectile using an optical or RF system sensitive to the angle of incidence of the received signal. Generally, the directing source is offset relative to the launching mechanism, be it gun barrel, mortar tube or rocket launcher. In early phases in flight, the aspect angle of the source to the round is such that the non-polarized detector output will be amplitude modulated due to the varying angle of incidence with the spin. In later phases of flight, the incidence variation may be caused by pitch over in the ballistic trajectory. This is similar to the side mounted reflector approach identified in U.S. Pat. No. 5,259,567 only in the present invention, a receiver is used rather than a reflector and it is rear mounted. A calibration phase may be implemented such that the source polarization aligns with the known incidence angle due to a-priori information concerning the relationship between launch and directing source. The peaking of the non-polarized detector will therefore be in phase with the rectified sinusoid generated by the polarized detector allowing unambiguous determination of polarization phasing. For example, if the illumination source for the command transmission were to the right, the polarization could initially be set to a horizontal orientation. The round would know the source is to the right. When the peak output from the non-polarized tilted detector and the polarized detector align, the round would uniquely establish the correct phase.

The use of a polarized command technique configured according to one embodiment of the present invention is especially well suited when applied to the control of the projectile using moving masses and other motion control devices 70. The use of moving masses has been proposed in U.S. Pat. No. 5,788,180 and various other published sources. Key to the generation of a stationary moment with a moving mass is that the motion must be sinusoidal and synchronous with the spin of the round. The spin rate of the round can vary throughout the flight. The direction of the generated moment is determined by the relative phase of the moving mass to the body angle in inertial space.

The polarized detector generates a sinusoid that is in synchronization with the roll orientation of the round. This sinusoid can be used as the input command for the control system 70 used to drive the moving mass 100. Modification of the polarization direction causes commanded and generated course correction.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system for the remote control of a spinning projectile, the system comprising:

A linear polarized radiation source emitting linear polarized radiation wherein commands are encoded in rotation of polarization of said polarized radiation;

A projectile round;

A polarized radiation receiver disposed on said projectile round and configured to receive said polarized radiation;

A projectile steering mechanism, said mechanism directing movement of said projectile according to said commands communicated by rotation of polarization of said linear polarized radiation source.

2. The system of claim 1, wherein said radiation is radio waves.

3. The system of claim 1, wherein said radiation is light.

4. The system of claim 1, wherein said projectile steering mechanism comprises a moving mass system.

5. The system of claim 4 wherein said moving mass system comprises a moving mass control module, configured to control a moving mass motor configured to actuate a mass within said projectile according to commands issued by the moving mass module, and a moving mass position indicator whereby a position of the mass is provided to the moving mass control module.

6. The system of claim 1 wherein said projectile steering mechanism comprises a thruster system.

7. The system of claim 6 wherein said thruster system comprises a thruster control configured to activate and deactivate a thruster, said thruster being configured to provide a thrust impulse to divert said projectile into a preferred path.

8. The system of claim 1 wherein said radiation receiver is disposed at a distal end of said projectile.

9. The system according to claim 1 further comprising a non-polarized radiation detector configured to receive a reference signal whereby ambiguity as a commanded thrust vector of said projectile round in inertia space is resolved.

10. The system according to claim 1 wherein said projectile steering mechanism comprises aerodynamic control surfaces.

11. A method for the active control of a spinning projectile in flight, said method comprising;

Launching a spinning projectile;

Directing polarized radiation toward a polarized radiation detector disposed on a distal end of said projectile, said detector receiving said polarized radiation being received by said projectile in a sinusoidal signal resulting from rotation of said projectile with two maxima for each rotation;

Communicating a maneuver command to said projectile by rotating said polarization thereby orienting said projectile thrust vector in inertial space.

12. The method according to claim 11 further comprising embedding additional information in said polarized radiation.

13. The method according to claim 11, wherein communicating a maneuver command further comprises embedding a rapid series of pulses embedded on a polarized signal.

14. The method according to claim 11 further comprising resolving a positive and negative angle ambiguity by:

commanding a maneuver;

observing a resulting movement of said projectile with a detection and ranging system.

15. The method according to claim 14, wherein said detection and ranging system is selected from the group of detection and ranging systems consisting of LADAR and RADAR.

* * * * *